United States Patent [19]

Nijhawan et al.

[11] Patent Number: 4,477,910

[45] Date of Patent: Oct. 16, 1984

[54] FUMES CONTROL SYSTEM FOR ELECTRIC ARC FURNACES

[75] Inventors: Pramodh Nijhawan, Winston-Salem; Eugene D. Schaltenbrand, Clemmons, both of N.C.

[73] Assignee: The Bahnson Company, Winston-Salem, N.C.

[21] Appl. No.: 482,912

[22] Filed: Apr. 7, 1983

[51] Int. Cl.[3] ..... F27D 17/00

[52] U.S. Cl. ..... 373/9

[58] Field of Search ..... 373/9, 79; 98/115 R, 98/115 VM; 266/158

[56] References Cited

U.S. PATENT DOCUMENTS

| | | | |
|---|---|---|---|
| 3,979,551 | 9/1976 | Overmyer et al. . | |
| 4,088,824 | 5/1978 | Bonistalli | 373/9 |
| 4,410,166 | 10/1983 | Hixenbaugh et al. | 373/9 |

*Primary Examiner*—Roy N. Envall, Jr.

*Attorney, Agent, or Firm*—Dann, Dorfman, Herrell and Skillman

[57] ABSTRACT

A fumes control system for use with a furnace having a top-chargeable furnace vessel mounted on a first support with means for charging the furnace adjacent to the vessel and means for collecting the melt from the furnace adapted to overlie a second support defining a tapping site adjacent to the furnace vessel. The fumes control system comprises a housing covering the top and sides of the furnace in sealing engagement with the first and second supports and is adapted to entirely enclose the furnace and collecting means. The fumes control system further comprises exhaust means with dampers associated therewith, which dampers are interconnected via control means to selectively exhaust fumes generated during charging, melting/refining and tapping operations at the respective sites.

9 Claims, 5 Drawing Figures

FUMES CONTROL SYSTEM FOR ELECTRIC ARC FURNACES

FIELD OF THE INVENTION

The present invention relates to a fumes control system designed to collect emissions generated during the operative stages of various melting and refining furnaces. The invention has particular application to electric arc furnaces.

BACKGROUND OF THE INVENTION

Electric arc furnaces are used for melting scrap and refining iron and steel. These furnaces are typically vessels equipped with a rotatable top with associated electrodes used as the melting source. The furnace is carried by a tiltable base or other movable structure so that, upon completion of melting or refining, molten metal may be poured from a pour spout or tap hole at the lower portion of the vessel into a collecting ladle.

Emissions produced during the operation of an electric arc furnace average one percent to two percent of the weight of the metal poured. The emissions are in the form of gaseous pollutants and fine particulate matter, and are discharged during three distinct stages of furnace operation. The first stage in which waste matter is generated is during the charging of the furnace. During charging, the furnace top and associated electrodes are pivotally moved to one side of the furnace while scrap metal and/or molten metal are added to the furnace vessel. The second stage which generates extensive emissions is the melt-down or refining stage where fumes escape through various openings during melting, during addition of flux or alloying materials and also during temperature determination and sampling. The third stage producing emissions is the tapping stage where molten metal is poured into a receiving or collecting ladle.

Under current environmental controls, emissions generated during operation of the electric arc furnace should not be discharged into the atmosphere. Prior art methods aimed at collecting emissions generated during operation of electric arc furnaces fall into one of four categories.

The first, furnace evacuation, withdraws fumes through an opening in the furnace roof or a side-draft hood around the electrodes. Additional shrouds over the tap hole, electrode holes and charging doors also withdraw furnace fumes from these respective sites. This system does not meet present day codes and, furthermore, does not adequately collect fumes generated when the top is off the furnace for scrap charging nor during the tapping stage.

The second method comprises withdrawing fumes through a canopy in the roof of the building. The canopy is at a distance from the site of fume generation. As a result, abnormally large exhaust air volumes must be moved to attain satisfactory in-plant conditions, and, since the total exhaust is cleaned before it is discharged into the atmosphere, operating costs are high. Therefore, it desirable to keep the the exhausted air volume to a minimum for economic reasons.

The third method, complete shop evacuation, adequately removes waste matter generated during operation of the furnace. However, complete shop evacuation also requires cleaning large volumes of gas. In addition, between evacuations, the shop atmosphere is dirty and hazardous to workers.

The fourth and relatively recent method comprises partially enclosing the furnace within a housing which covers the top and sides of the furnace. The housing is sized to enable tilting of the furnace during the tapping stage where the molten metal is poured into a ladle located outside the enclosure. The housing typically contains a primary exhaust means in the upper area of the housing to collect fumes generated during furnace operations. An additional supplementary exhaust system means is provided adjacent the tapping site to specifically remove pollutants generated during the tapping stage. A major drawback of this method is that the housing does not fully enclose the ladle and thus does not effectively remove fumes generated during tapping. Therefore, some of the extensive fumes generated during the tapping operation inevitably escape into the shop. Also, the primary and secondary exhaust means within such a housing typically operate continuously during all stages of furnace operation and are not selectively controlled to reduce the volume of gas which must be thereafter cleaned before being discharged into the atmosphere.

SUMMARY OF THE INVENTION

The present invention provides an enhanced fumes control system for furnaces such as the electric arc furnace without the above-mentioned disadvantages of prior art methods.

In accordance with the present invention, the collection of emissions generated during the operation of furnaces such as the electric arc furnace is enhanced by entirely enclosing the furnace and collecting means within a housing and selectively controlling the exhaust of pollutants produced at the charging, melting/refining and tapping stages. Selectively controlling the exhaust of pollutants is accomplished by utilizing a series interconnected dampers located within the exhaust means.

Electric arc furnace systems typically have a first support on which a tiltable, top-chargable furnace vessel is mounted. The furnace system has means for charging the furnace vessel at a site adjacent to the furnace vessel and a pour spout or the like defining a tapping site adjacent to the furnace vessel. A second support, contiguous with the first, supports the means for collecting melted and refined metals at the tapping site.

Emissions generated during the several operative stages of the furnace are effectively collected, as mentioned above, by entirely enclosing both the furnace and collecting means within the housing, which housing is in sealing engagement with the first and second supports and has an upper area defining a clear space overlying the furnace. Selective collection of emissions generated at each stage of the furnace's operation is effected by providing a first exhaust means proximate the upper area of the housing and a second exhaust means adjacent to the tapping site. The first and second exhaust means are connected to a common discharge means. A third exhaust means, such as a fourth hole or side-draft exhaust system is preferably connected to the common discharge means to exhaust fumes generated during melting and refining operations. Control dampers associated with the several exhaust and common discharge means are interconnected to be alternately open and throttled so as to selectively exhaust waste matter generated during the charging, melting/refining or tapping stages at their respective sites.

From this brief description, it will be appreciated that the present invention collects fumes generated during all stages of the furnace operation and obviates the need for additional shrouds at various fume-generating sites. In addition, selective exhausting of fumes by interconnected control damper means reduces the amount of air which is admixed with pollutant fumes, which in turn reduces the volume of the gas which must thereafter be cleaned, and thus, obviates the need for large and expensive cleaning systems. Finally, the present invention obviates the need for evacuating the shop during cleaning operations and eliminates many of the health-related problems associated with prior art methods.

BRIEF DESCRIPTION OF THE DRAWINGS

The foregoing summary as well as the following detailed description of a preferred embodiment of the present invention will be better understood when read in conjunction with the accompanying drawings, in which.

DETAILED DESCRIPTION OF THE INVENTION

Figure 1:
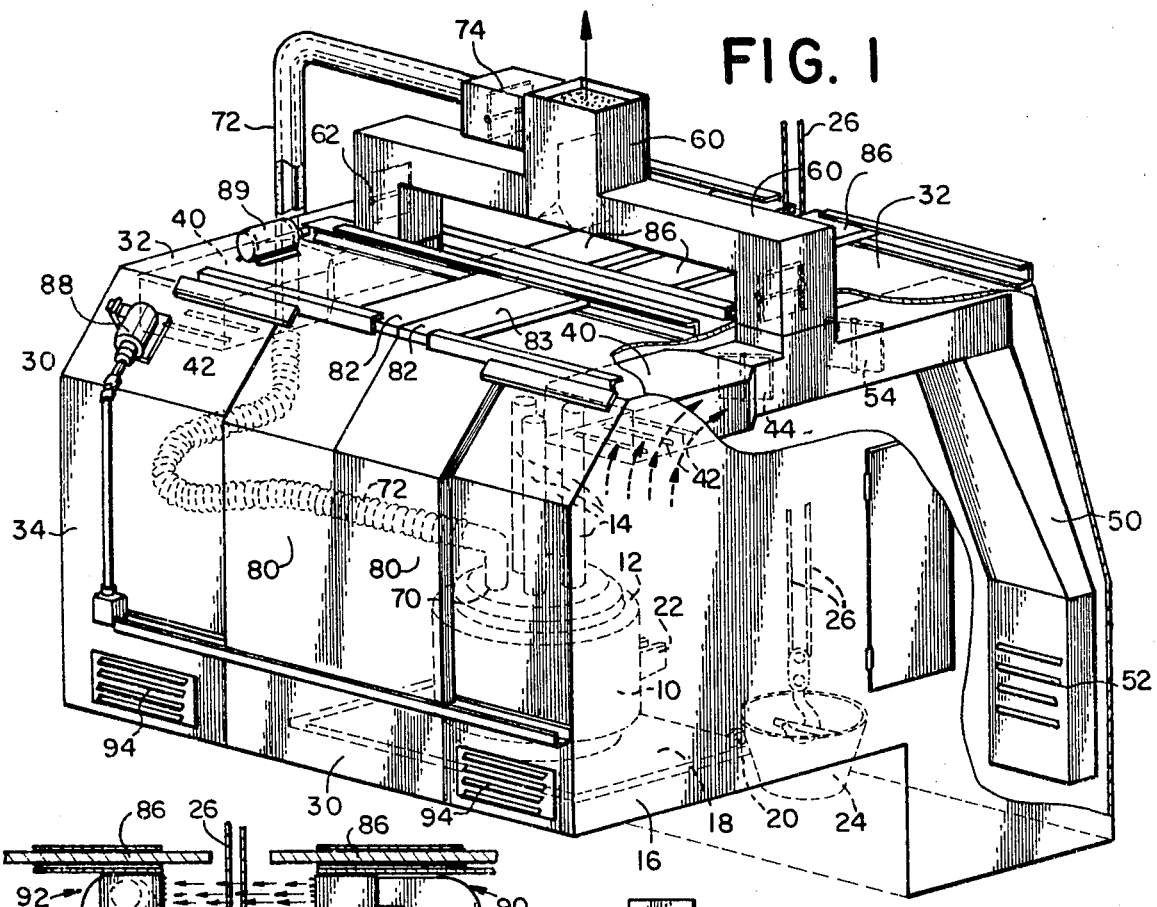
FIG. 1 is a perspective view of an electric arc furnace and a fumes control system constructed in accordance with the present invention, with a part of the housing broken away to illustrate part of the exhaust system.
Figure 2:
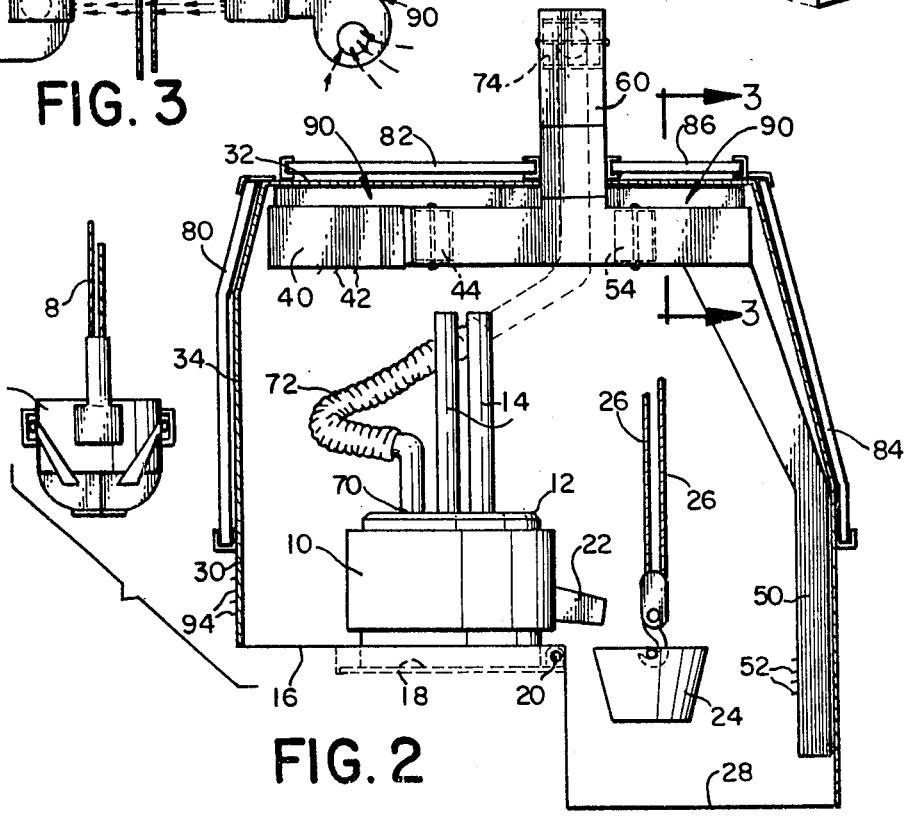
FIG. 2 is a sectional view of the electric arc furnace and fumes control system taken adjacent the end wall as shown in FIG. 1, the furnace including a charging bucket adjacent the housing.

In the top-chargable electric arc furnace and fumes control system illustrated in FIGS. 1–5, there is a furnace having a primary vessel 10, and means for charging the furnace positioned adjacent to vessel 10, which charging means is best illustrated in FIG. 2 as comprising a charging bucket 6 which is movable to and from the furnace by movable suspension member 8. The furnace itself includes for vessel 10, a rotatable top 12 having three electrodes 14 associated therewith. The rotatable top 12 and associated electrodes 14 are mounted to vessel 10 to enable pivotal movement of the top to one side of the vessel during charging of the furnace. The vessel is positioned on a first support 16 as shown in FIGS. 1 and 2, which support comprises a base 18 to enable tilting of the vessel about a pivot 20 during tapping operations, which pivot is best illustrated in FIG. 2. The melted and refined materials are discharged through pour spout 22, which spout defines a tapping site adjacent to the furnace. Means for collecting the melted and refined material discharged or tapped from vessel 10 through pour spout 22 in the present instance comprises a ladle 24, which ladle is movable to and from the tapping site by movable suspension member 26 best illustrated in FIGS. 1–2. The collecting means may overlie or rest upon a second support 28 at the tapping site which support is contiguous with first support 16.

This above-described electric arc furnace is of conventional construction and is the source of large quantities of pollutant emissions, both gases and fine particulate matter, during operation thereof.

The present invention provides a fumes control system designed to selectively collect and convey emissions generated during the several operative stages of the furnace to control areas. The illustrated embodiment of the fumes control system shown in FIGS. 1, 2 and 4 comprises a housing 30 covering the top and sides of the furnace, which housing is in a sealing engagement with the first and second supports 16 and 28 to entirely enclose the furnace and collecting means during all stages of furnace operation, said housing also providing an upper area overlying the furnace vessel to provide a clear space above the vessel. The upper area of the housing includes a roof section 32 shown in FIGS. 1–2 which defines the upper boundary of the clear space of the housing and which is sufficient in height to permit the rotatable top with associated electrodes to be raised and lowered during charging and cleaning of the furnace. The housing also has walls 34 which enclose the sides of the furnace, which walls are in a sealing engagement with the first and second support 16 and 24, and are of sufficient width to permit operation of the furnace during its several operative stages.

The housing includes movable sections to enable movement of the charging and collecting means and comprises a first entry means for entry of charging bucket 6 into the housing and second entry means for entry of collecting ladle 24 into the housing. The first entry means provided for entry of the charging means into the housing comprises a lower portal 80 for charging bucket 6 and an upper portal 82 for entry of suspension member 8 associated therewith. The lower portal is open only during movement of the charging bucket and the upper portal is opened during movement of the charging bucket and also when the bucket is in the charging site. The second entry means for entry of the collecting means into said housing comprises a lower portal 84 for ladle 24 and an upper portal 86 for suspension member 26 associated therewith. The lower portal for the ladle is opened only during movement of the ladle while the upper portal is opened during movement of the ladle and also when the ladle is at the tapping site. As best illustrated in FIGS. 1 and 2, the upper and lower portals of the first and second entry means each comprise closures, in the present instance, a pair of sliding doors, which open and close from the center of their respective portals. As can be seen from FIG. 1, these sliding doors may be opened and closed by electric motor means 88 and 89, and, although not shown in the drawings, the upper and lower portals 84 and 86 of the second entry means may similarly be opened and closed by suitable motor means.

As mentioned above, during charging operations, lower and upper portals 80 and 82 will be open when charging bucket 6 is moved to and from furnace vessel 10. During charging, lower portal 80 is closed to minimize escape of fumes. Upper portal 82 must remain open during charging since movable suspension member 8, in addition to allowing the charging bucket to be moved to and from the vessel, supports the bucket during charging.

During tapping operations, lower and upper portals 84 and 86 will be open when ladle 24 is moved to and from the tapping site. During tapping, lower portal 84 is closed to minimize escape of fumes. Upper portal 86 must also remain open during tapping since movable suspension member 26, in addition to allowing the ladle to be moved to and from the tapping site, supports the ladle during tapping.

Finally, during melting and refining operations, all portals will remain closed.

Figure 3:
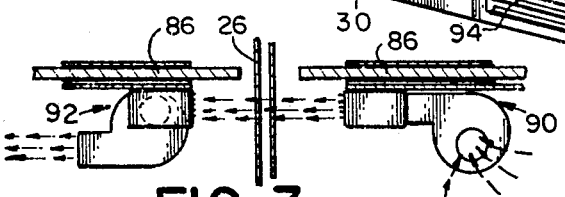
FIG. 3 is a fragmentary sectional view of an air curtain apparatus as taken along line 3—3 of FIG. 2.

The fumes control system may also include an alternate closure for the above-mentioned portals, comprising, in the present instance, an air curtain apparatus 90. As shown in FIG. 3, air curtain apparatus 90 is proximate to said upper portals of said first and second entry means. As shown, the apparatus directs a flow of air from within the housing across at least these upper portals toward exhaust inlet 92 to form an air curtain which restricts the flow of fumes through the entry means when the respective entry means are open. In particular, the air curtain apparatus associated with upper portals 82 and 86 restricts the flow of fumes through said open entry means specifically during charging and tapping operations. The curtain, therefore, serves as an effective closure to prevent the escape of fumes from the housing when the upper portals are open to afford passage of suspension members 8 and 26.

Means are provided to exhaust fumes generated and emitted during charging, melting/refining and tapping operations of the furnace. The exhaust means typically comprise conduits with inlets and may have control dampers associated therewith to selectively collect and remove emissions from the housing during all stages of the furnace operation at the respective operative sites.

As best illustrated in FIGS. 1 and 2, a first exhaust means comprising a conduit 40 with an inlet 42 and a first control damper 44 associated therewith is provided proximate the upper area of the housing to selectively collect and remove emissions from the housing primarily during during the charging of the furnace and also during refining, if the furnace is not equipped with an independent exhaust means designed to capture emissions generated during the melting and refining stage. As shown in FIG. 1, the inlets of the first exhaust means may be located at both sides of the portals, particularly the upper portal 82. The inlets 42 associated with the conduits 40 of said first exhaust means should preferably be positioned at the end of the conduits 40 but above the charging site so as to effectively capture those fumes generated during charging and melting/refining operations.

A second exhaust means comprising a conduit 50 with inlet 52 and second control damper 54 associated therewith is provided adjacent to the tapping site as best illustrated in FIGS. 1–2 for selective removal of emissions generated primarily during tapping operations. During tapping, the furnace with rotatable top 12 and associated electrodes intact thereon, is tilted so that the furnace contents are discharged through pour spout 22 into ladle 24. The large quantities of emissions released during tapping pass through inlet 52 into conduit 50. The second exhaust means may similarly be located on both sides of the portals, particularly lower portal 84. Inlet 52 associated with conduit 50 of said second exhaust means should preferably be positioned in the lower part of conduit 50 to effectively capture fumes emitted during tapping operations.

Although the inlets 42 and 52 are offset from the furnace vessel 10 to afford access by the charging bucket 6 and ladle 24, there is sufficient draft to effectively discharge the pollutants from the environs of the vessel.

Figure 4:
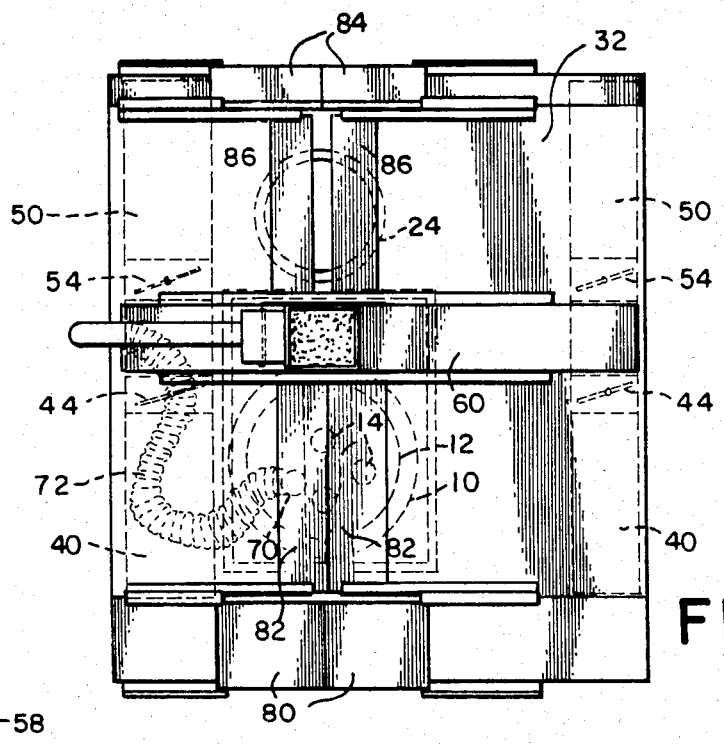
FIG. 4 is a plan view of the electric arc furnace and fumes control system as shown in FIG. 1.

A common discharge means comprising conduit 60 connects said first and second exhaust means and may operate continuously to exhaust emissions from the respective sites alternately. The common discharge means may have associated therewith a third control damper 62 as best illustrated in FIGS. 1 and 4.

A third independent exhaust system may be provided to capture the large amount of emissions generated during melting and refining operations of the furnace. FIGS. 1, 2 and 4 illustrate one type of independent exhaust system, commonly known in the prior art as a fourth-hole exhaust system. The fourth-hole exhaust system comprises a fourth hole 70, a conduit 72, which conduit has an inlet at the furnace and an outlet connected to the common discharge means at a point downstream from the third control damper 62 and, may have associated therewith, a fourth control damper 74.

While a fourth-hole system is shown and described in the drawings as a preferred embodiment of the third independent exhaust system, it is to be understood that the invention is not limited thereto but may be otherwise variously embodied to include other independent exhaust systems such as a side-draft exhaust system.

The housing is also provided with a series of fixed louvers 94. Since fumes are constantly being exhausted during the various operative stages of the furnace resulting in the housing being under a negative pressure, fixed louvers enable shop air to enter the housing to replace air that is being exhausted with the fumes. Inlets 42 and 52 may be seen as cooperating with louvers 94 to scavange the fumes from the housing. The louvers are preferably mounted on side walls 34 of the housing and are best positioned in the lower areas of the side walls as shown in FIG. 1 so as not to interfere with exhausting of the fumes at the several operative sites, and to allow the fresh air from the shop to sweep across the support 16 toward the inlet 52 and along the furnace outlet 12 toward the inlets 42.

Means is provided to actuate the several above-mentioned control dampers in coordination with the operative stages of the furnace.

Figure 5:
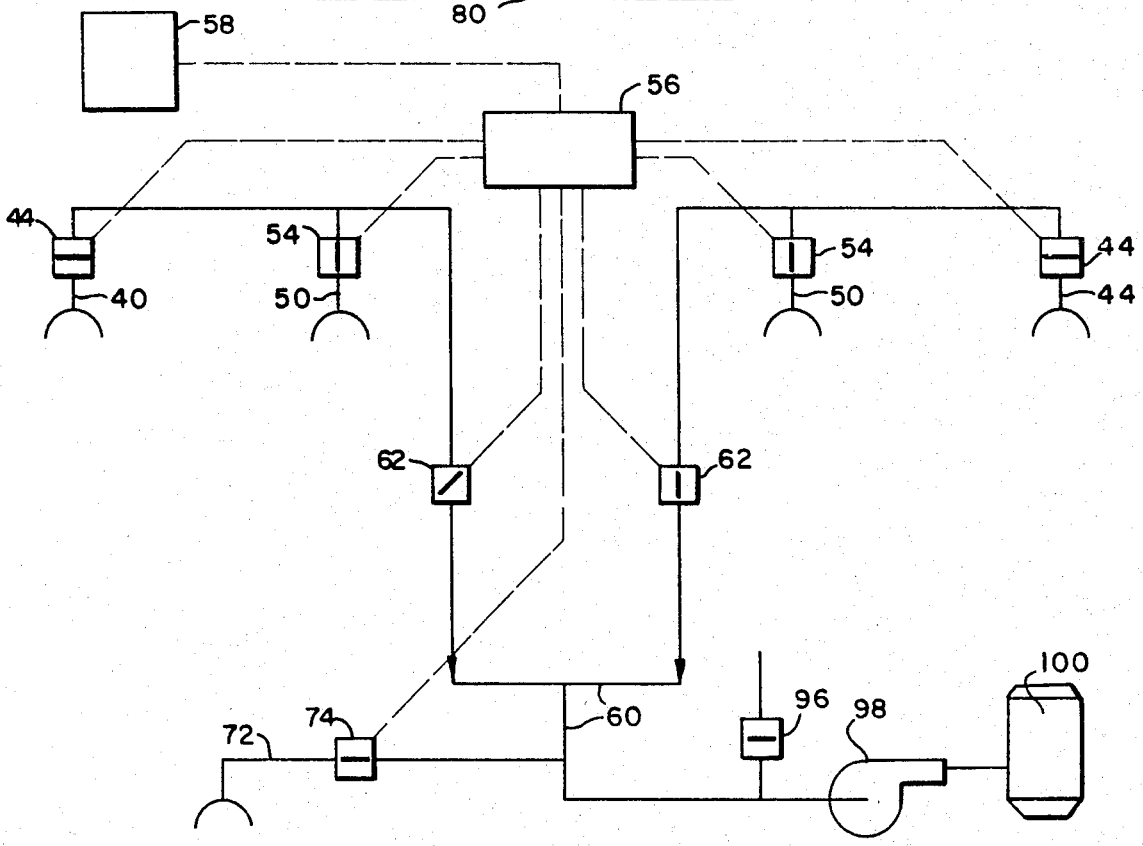
FIG. 5 is a schematic illustration of the fumes control system showing the selective control of collection of emissions from the furnace in accordance with the present invention.

Control means 56, illustrated in the schematic diagram of FIG. 5, is responsive to the operation of the furnace controls indicated at 58 and interconnects first control damper 44 and second control damper 54 to open the first exhaust means and throttle the second exhaust means during charging of the furnace and throttle the first exhaust means and open the second exhaust means during tapping of the furnace. Preferably, during melting and refining operations, first control damper 44 is partially open while second control damper 54 is fully throttled.

Control means 56 may also interconnect the third control damper 62 with the first and second dampers, 44 and 54 respectively, to open said common discharge means primarily during charging and tapping of the furnace and to throttle said common discharge means during melting and refining if the fumes control system includes an independent exhaust system designed to capture emissions generated during melting and refining stages. Otherwise, the common discharge means remains open during all stages of the furnace operation.

Finally, the control means 56 may interconnect said first, second, third and fourth control dampers to open the third and independent exhaust means during melting and refining operations, and to throttle said third exhaust means during charging and tapping operations.

The overall effect of control means 56 interconnecting said control dampers is to selectively exhaust fumes from within the housing at the operative site at which they are produced. Selective exhausting of the furnace fumes according to the present invention minimizes the volume of gas which must thereafter be cleaned before being discharged into the atmosphere.

A schematic representation of control means 56 interconnecting the first, second, third and fourth control dampers is illustrated in FIG. 5. The control means is shown as being responsive to the charging, refining and tapping operations of the furnace indicated at 58. FIG. 5 particularly illustrates the damper control configuration during tapping of the furnace where the first and fourth control dampers 44 and 74 are fully throttled, second control dampers 54 is fully opened, and the third control dampers 62 is either fully opened or partially throttled. Also illustrated in FIG. 5 is an emergency bleed-in-air means 96, and a suction device such as a fan 98, which fan exhausts fumes from the housing through the first, second and third exhaust systems into any suitable dust collector such as a bag house 100.

Without departing from the concept of the invention, the fumes control system may be changed and modified to selectively exhaust fumes from other melting and refining furnaces such as an induction furnace. Hence, while a fumes control system for an electric arc furnace has been shown and described as a preferred embodiment of the invention, it is to be understood that various changes, modifications, and alterations may be made in the described embodiment of the present invention without departing from the spirit and scope thereof as defined in the appended claims.

It is claimed:

1. For a furnace having a first support, a tiltable, top-chargeable furnace vessel mounted on said first support, means for charging said furnace vessel at a charging site adjacent said furnace, said furnace having a tapping site adjacent said furnace, means for tapping said furnace at said tapping site, a second support contiguous with said first support, means adapted to overlie said second support at said tapping site for collecting melted and refined metals from said furnace vessel, and furnace controls for said charging means and said tapping means, a fumes control system comprising:

(a) a housing covering the top and sides of said furnace in sealing engagement with said first and second supports, and adapted to entirely enclose said furnace and collecting means, said housing having an upper area defining a clear space overlying said furnace;

(b) a first exhaust means having an inlet in said clear space proximate the upper area of said housing and having a first control damper associated therewith;

(c) a second exhaust means having an inlet within the housing adjacent to said tapping site and having a second control damper associated therewith;

(d) a common discharge means connected to said first and second exhaust means; and (e) control means coupled to said furnace controls and interconnecting said first and second control dampers to open said first exhaust means and throttle said second exhaust means during charging and to throttle said first exhaust means and open said second exhaust means during tapping, whereby said common discharge means may operate continuously to exhaust fumes from the respective sites alternately.

2. A fumes control system for a furnace as defined in claim 1, wherein said charging means comprises a charging bucket movable into and away from said charging site and said collecting means comprises a collecting ladle movable into and away from said tapping site, said housing including movable sections to enable said movement of said charging means and said collecting means comprising a first entry means for entry of said charging bucket into said housing and a second entry means for entry of said collecting ladle into said housing, and said system including an air curtain apparatus proximate to said first and second entry means for directing a flow of air from within said housing across said first and second entry means to form an air curtain restricting flow of fumes through said entry means when said respective entry means are open.

3. A fumes control system for a furnace as defined in claim 2, wherein said charging means includes a movable suspension member for moving said bucket, said first entry means comprising a lower portal for said charging bucket and an upper portal for said suspension member, said lower portal being opened only during movement of said bucket into and out of said housing and said upper portal being open during said movement of said bucket and also whenever said bucket is in said housing to thereby accomodate said suspension member, and being closed when said bucket is outside of said housing, said air curtain apparatus being associated with said upper portal of said first entry means.

4. A fumes control system for a furnace as defined in claim 2, wherein said collecting means includes a movable suspension member for moving said ladle, said second entry means comprising a lower portal for said collecting ladle and an upper portal for said suspension member, said lower portal being opened only during movement of said ladle into and out of said housing and said upper portal being open both during said movement of said ladle and also whenever said ladle is in said housing to thereby accomodate said suspension member, and being closed when said ladle is outside of said housing, said air curtain apparatus being associated with said upper portal of said second entry means.

5. A fumes control system for a furnace as defined in claim 1, wherein said furnace includes means operated between said tapping and charging operations to melt and refine the metals, said system including a third control damper positioned within said common discharge means, said control means interconnecting said first, second and third control dampers to open said common discharge means during charging and tapping operations and to throttle said common discharge means between tapping and charging operations.

6. A fumes control system for a furnace as defined in claim 5, including a third exhaust means having an inlet connected to said furnace and an outlet connected to said common discharge means downstream from said third control damper to exhaust fumes generated in the furnace during melting and refining operations, a fourth control damper associated with said third exhaust means and said control means interconnecting said fourth damper with said first, second and third control dampers to open said third exhaust means during melting and refining operations and to throttle said third exhaust means during charging and tapping operations.

7. A fumes control system for a furnace as defined in claim 6, wherein said furnace comprises an electric arc furnace and said third exhaust means comprises a fourth hole exhaust system.

8. A fumes control system for a furnace as defined in claim 6, including connection between said furnace controls and said control means whereby said first and third control dampers are open and said second and fourth control dampers are throttled during charging operations, said second and third control dampers are open and said first and fourth control dampers are throttled during tapping operations, and said fourth control damper is open and said first, second and third control dampers are throttled during melting and refining operations.

9. A fumes control system for a furnace as defined in claim 1, wherein said fumes control system includes fixed louvers on said housing to enable entry of air from outside said housing, which louvers cooperate with said inlets of said first and second exhaust means to scavange fumes from said housing.

* * * * *